US006045082A

United States Patent [19]

Plociennik et al.

[11] Patent Number: 6,045,082

[45] Date of Patent: Apr. 4, 2000

[54] COILING METHOD FOR WIRE-SHAPED ROLLING STOCK AND COILING DEVICE FOR CARRYING OUT THE METHOD

[75] Inventors: Uwe Plociennik, Ratingen; Karl Keller; Andreas-M. Lutz, both of Hilchenbach, all of Germany

[73] Assignee: SMS Schloemann-Siemag Aktiengesellschaft, Düsseldorf, Germany

[21] Appl. No.: 09/154,726

[22] Filed: Sep. 16, 1998

[30] Foreign Application Priority Data

Sep. 22, 1997 [DE] Germany ..... 197 41 649

[51] Int. Cl.[7] ..... B65H 18/08

[52] U.S. Cl. ..... 242/476.6; 242/532.5; 242/586

[58] Field of Search ..... 242/476.6, 476.5, 242/586, 586.1, 532.5

[56] References Cited

U.S. PATENT DOCUMENTS

| | | | |
|---|---|---|---|
| 1,774,525 | 9/1930 | Remmen | 242/532.5 |
| 4,075,747 | 2/1978 | Hague et al. | 242/532.5 X |
| 4,116,394 | 9/1978 | Smith et al. | 242/476.6 |
| 4,770,361 | 9/1988 | Maeda | 242/532.5 |
| 5,005,776 | 4/1991 | Schwarz | 242/476.6 |
| 5,248,103 | 9/1993 | Polnik | 242/476.6 |

*Primary Examiner*—Donald P. Walsh
*Assistant Examiner*—Minh-Chau Pham
*Attorney, Agent, or Firm*—Friedrich Kueffner

[57] ABSTRACT

A coiling method for wire-shaped rolling stock having a rolling stock tip, wherein the rolling stock is supplied with its rolling stock tip at a rolling stock speed through an inlet guide means to a coiling drum having an initial circumference. A coiling device for carrying out the coiling method includes a coiling drum having an initial circumference onto which the rolling stock can be coiled with its rolling stock tip and an inlet device for supplying and transporting the rolling stock to the coiling drum. The coiling device further includes a clamping device arranged on the coiling drum and provided with a clamping gap which can be opened and closed. In addition, the coiling device includes a sensor device for detecting the rolling stock tip in the clamping gap.

8 Claims, 1 Drawing Sheet

COILING METHOD FOR WIRE-SHAPED ROLLING STOCK AND COILING DEVICE FOR CARRYING OUT THE METHOD

BACKGROUND OF THE INVENTION

1. Field of the Invention

The present invention relates to a coiling method for wire-shaped rolling stock having a rolling stock tip, wherein the rolling stock is supplied with its rolling stock tip at a rolling stock speed through an inlet guide means to a coiling drum having an initial circumference.

The present invention also relates to a coiling device for carrying out the coiling method. The coiling device includes a coiling drum having an initial circumference onto which the rolling stock can be coiled with its rolling stock tip and an inlet device for supplying and transporting the rolling stock to the coiling drum.

2. Description of the Related Art

A coiling method and a coiling device of the above-described type are known, for example, from the brochure "Feinstahlhaspeln System Garrett" of the company SKET published 1986. In accordance with this brochure, the rolling stock tip is "caught". However, the brochure does not say anything as to how and with what means the catching of the rolling stock tip is carried out. Catching of the rolling stock tip is indispensable for ensuring a problem-free production process.

SUMMARY OF THE INVENTION

Therefore, it is the primary object of the present invention to provide a coiling method and a coiling device for carrying out the method which makes it possible in the simplest possible manner to securely catch the rolling stock tip, wherein simultaneously a uniform coiling of the rolling stock is to be ensured from the beginning.

In accordance with the present invention, the above-mentioned object is met by a coiling method in which the coiling drum rotates with a rate of rotation which is selected in such a way that the initial circumferential speed of the coiling drum resulting from the rate of rotation and the initial circumference is equal to the rolling stock speed. A clamping gap of a clamping device arranged on the coiling drum is opened, so that the rolling stock can be inserted into the clamping gap with its rolling stock tip. The insertion of the rolling stock tip is detected by means of a sensor device. In addition, the clamping gap is closed and the rolling stock is transported from the inlet guide means to the coiling drum when the sensor device has detected the insertion of the rolling stock tip into the clamping gap.

Within the scope of the present invention, the word "transporting" means an active motor-driven transportation, contrary to "supplying" which, within the scope of the present invention, merely is to mean the guidance by guide elements. Of course, the rolling stock can also be transported during the guidance of the rolling stock.

The coiling device according to the present invention includes a clamping device arranged on the coiling drum and provided with a clamping gap which can be opened and closed. In addition, the coiling device includes a sensor device for detecting the rolling stock tip in the clamping gap.

When the clamping device for opening and closing the clamping gap is moved axially or the clamping device is in a corresponding manner axially moveable for opening and closing the clamping gap, the structural requirements for realizing the clamping device are particularly small. The clamping can be actuated optionally by the force of a spring, by a motor, or pneumatically or also hydraulically.

In accordance with another feature, the clamping gap is constructed on the initial circumference so as to be wave-shaped circumferentially, so that the rolling stock after being caught by the clamping device is securely coiled on the initial circumference and cannot further penetrate into the clamping gap.

In accordance with another feature, catching of the rolling stock tip is made particularly simple when the inlet guide means is guided so as to follow the clamping gap or, in a corresponding manner, the inlet guide means is provided with a guiding device for guiding the inlet guide means following the clamping gap.

The detection of the rolling stock tip is particularly safe and, most importantly quick, when the sensor device is constructed as a photocell.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
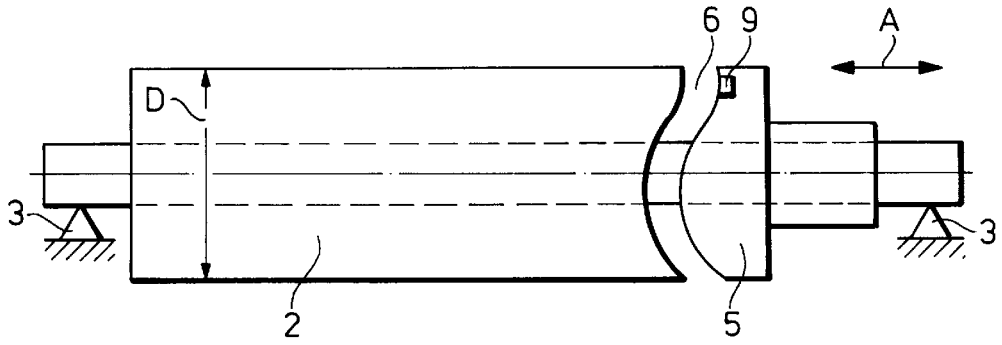
FIG. 1 is a schematic view of a coiling drum with a clamping device.
Figure 2:
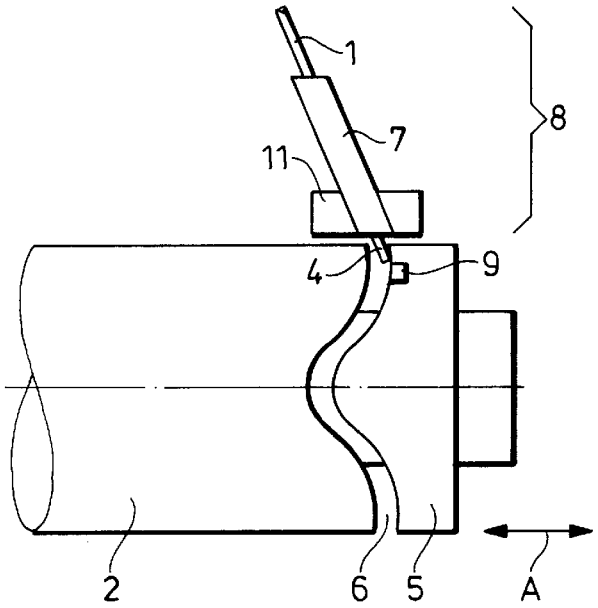
FIG. 2 is a top view of the coiling drum with the clamping device and with an inlet device.
Figure 3:
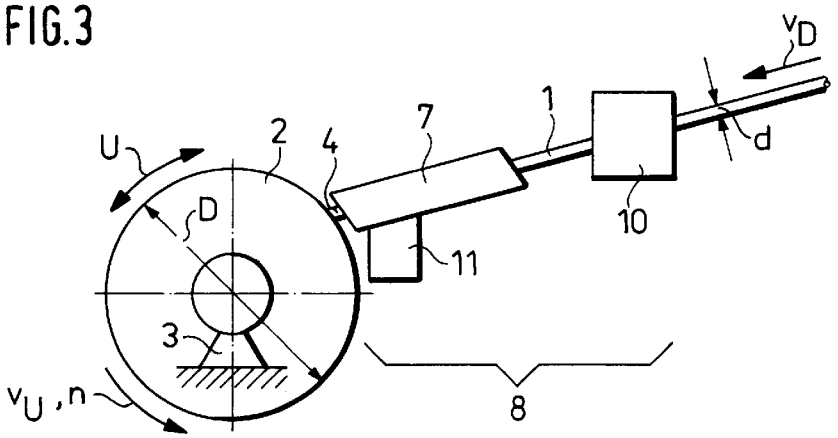
FIG. 3 is a side view of the coiling drum with the clamping device and the inlet device.

As illustrated in FIGS. 1–3, a wire-shaped rolling stock 1, referred to briefly as wire 1 hereinbelow, is to be coiled onto a coiling drum 2. The wire 1 is transported with a rolling stock speed $V_D$.

Prior to coiling, the coiling drum 2 has an initial circumference U which results in $U=\pi\times D$, wherein D is the initial diameter of the coiling drum 2. The coiling drum 2 is mounted on supports 3. By means of a drive, not shown, the coiling drum 2 is driven prior to the beginning of coiling of the wire 1 with a rate of rotation n. The rate of rotation n is selected in such a way that the initial circumferential speed $v_U$ of the coiling drum 2 is equal to the rolling stock speed $v_D$.

Before coiling of the wire 1 onto the coiling drum 2 can be begin, a wire tip 4 of the wire 1 must be fastened to the coiling drum 2. For this purpose, a clamping device 5 provided with a clamping gap 6 is mounted on the coiling drum 2. The clamping gap 6 can be opened and closed by axially moving the clamping device 5 in the direction of double arrow A. In the illustrated embodiment, the movement of the clamping device 5 is effected by an electric motor. However, other types of drives are also possible.

The possibilities for adjusting the clamping gap 6 must meet two requirements. First, it must be possible to open the clamping gap 6 to such an extent that a wire 1 having a maximum wire diameter can be inserted into the clamping gap 6. Second, it must be possible to close the clamping gap 6 to such an extent that a wire 1 having a minimum wire diameter is securely held in the clamping gap 6.

For inserting the wire 1, initially the clamping gap 6 is opened, so that the wire 1 can be inserted with its wire tip 4 into the clamping gap 6. This is illustrated in FIG. 1. Subsequently, the wire 1 is supplied by means of an inlet guide means 7 of an inlet device 8 to the clamping gap 6 and is threaded into the clamping gap 6. For inserting the wire 1, the clamping gap 6 can be opened completely. However, this is not absolutely required. It is sufficient if the clamping gap 6 is opened to such an extent that its gap width is slightly greater than the wire diameter d.

A sensor device 9 is arranged in the clamping gap 6. In the illustrated embodiment, the sensor device 9 is a photocell. The sensor device 9 is configured to detect as to whether or not the wire 1 has been inserted with its wire tip 4 into the clamping gap 6. If this is the case, the sensory device 9 provides a signal to a control device, not shown. This control device then initiates closing of the clamping gap 6. In addition, the sensor device 9 provides a start signal to the inlet device 8. The inlet device 8 then controls an inlet drive 10 by means of which the wire 1 is transported to the coiling drum 2.

As illustrated in FIGS. 1 and 2, the clamping device 5 is moved axially for opening and closing the clamping gap 6.

Of course, even though the clamping device 5 is closed, the clamping gap 6 is not completely closed because the wire tip 4 is placed in the clamping gap 6. In order to prevent the wire 1 to be coiled from sliding into the clamping gap 6, the clamping gap 6 extends in a wave-shaped configuration on the initial circumference U.

In order to ensure a secure grasping of the wire in spite of the oscillation of the clamping gap 6, the inlet guide means 7 is provided with a guiding device 11. In the illustrated embodiment, this guiding device 11 is a guide lock. The guiding device 11 serves to guide the inlet guide means 7 so as to follow the clamping gap 6 so that the positions of the clamping gap 6 and the inlet guide means 7 are ensured to always coincide.

The coiling method described above and the coiling device for carrying out the method are suitable for all types of wire-shaped rolling stock. However, they are used with particular advantage for coiling wire at high speeds, i.e., when the rolling stock speed $v_D$ is greater than 20 m/s.

Finally, it should be noted that the sensor device 9 can also be arranged outside of the clamping gap 6.

While specific embodiments of the invention have been shown and described in detail to illustrate the inventive principles, it will be understood that the invention may be embodied otherwise without departing from such principles.

We claim:

1. A coiling method for wire-shaped rolling stock having a rolling stock tip, the method comprising supplying the rolling stock with the rolling stock tip thereof at a rolling stock speed through an inlet guide means through a rolling drum having an initial circumference, rotating the coiling drum at a rate of rotation about an axis of rotation, wherein the rate of rotation is selected such that an initial circumferential speed of the coiling drum resulting from the rate of rotation and the initial circumference is equal to the rolling stock speed, opening a clamping gap of a clamping device mounted on the coiling drum such that the rolling stock can be inserted with the rolling stock tip thereof into the clamping gap, detecting the insertion of the rolling stock tip by a sensor device, closing the clamping gap and transporting the rolling stock from the inlet guide means to the coiling drum when the sensor device has detected the insertion of the rolling stock tip into the clamping gap, further comprising moving the clamping device in the axial direction of the coiling drum for opening and closing the clamping gap.

2. The coiling method according to claim 1, wherein the clamping gap has a wave-shaped configuration extending circumferentially on the initial circumference of the coiling drum, further comprising guiding the inlet guide means so as to follow the clamping gap.

3. The coiling method according to claim 1, wherein the rolling stock speed is greater than 20 m/s.

4. A coiling device for coiling wire-shaped rolling stock having a rolling stock tip, the coiling device comprising a coiling drum having an axis of rotation and an initial circumference, a clamping device mounted on the coiling drum and having a clamping gap which can be opened and closed, a sensor device for detecting the rolling stock tip in the clamping gap, and an inlet guide means for supplying and transporting the rolling stock to the coiling drum, so that the rolling stock is coiled onto the initial circumference of the coiling drum., wherein the clamping device is mounted so as to be moveable in the axial direction of the coiling drum for opening and closing the clamping gap.

5. The coiling device according to claim 4, wherein the sensor device is a photocell.

6. The coiling device according to claim 4, wherein the clamping gap is configured so as to extend circumferentially in a wave-shaped configuration on the initial circumference.

7. The coiling device according to claim 6, further comprising a guiding device for guiding the inlet guide means so as to follow the clamping gap.

8. The coiling device according to claim 7, wherein the guiding device is comprised of a guide block.

* * * * *